US012280861B2

(12) United States Patent
Saruwatari

(10) Patent No.: US 12,280,861 B2
(45) Date of Patent: Apr. 22, 2025

(54) OUTBOARD MOTOR

(71) Applicant: YAMAHA HATSUDOKI KABUSHIKI KAISHA, Iwata (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 532 days.

(21) Appl. No.: 17/863,471

(22) Filed: Jul. 13, 2022

(65) Prior Publication Data

US 2023/0066941 A1 Mar. 2, 2023

(30) Foreign Application Priority Data

Aug. 30, 2021 (JP) ..... 2021-140527

(51) Int. Cl.

| | |
|---|---|
| ***B63H 20/32*** | (2006.01) |
| ***B63H 20/12*** | (2006.01) |
| ***B63H 20/14*** | (2006.01) |
| ***B63H 20/24*** | (2006.01) |
| ***B63H 20/28*** | (2006.01) |
| ***B63H 23/30*** | (2006.01) |
| ***B63H 23/34*** | (2006.01) |

(52) U.S. Cl.

CPC ..... *B63H 20/32* (2013.01); *B63H 20/12* (2013.01); *B63H 20/14* (2013.01); *B63H 20/24* (2013.01); *B63H 20/28* (2013.01); *B63H 23/30* (2013.01); *B63H 23/34* (2013.01)

(58) Field of Classification Search

CPC ..... B63H 20/32; B63H 21/12; B63H 23/30

See application file for complete search history.

(56) References Cited

U.S. PATENT DOCUMENTS

| | | | | |
|---|---|---|---|---|
| 2004/0069271 | A1* | 4/2004 | Kanno | F02D 9/1065 123/399 |
| 2004/0229524 | A1* | 11/2004 | Mizuguchi | F02B 61/045 440/61 S |
| 2010/0167604 | A1* | 7/2010 | Inaba | B63H 20/12 440/60 |
| 2023/0096971 | A1* | 3/2023 | Nakayama | F02B 29/0418 123/563 |
| 2024/0425164 | A1* | 12/2024 | Masuda | B63H 20/32 |

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

An outboard motor includes a drive shaft cover to cover a drive shaft extending downwardly from an engine, a lower unit turnable with respect to the drive shaft cover, and a harness. A lower housing of the lower unit houses a lower portion of the drive shaft and an electrical component. The harness is connected to the electrical component through an upper space provided in the drive shaft cover and through a lower space that communicates with the upper space from below in the lower housing.

12 Claims, 8 Drawing Sheets

OUTBOARD MOTOR

CROSS REFERENCE TO RELATED APPLICATIONS

This application claims the benefit of priority to Japanese Patent Application No. 2021-140527 filed on Aug. 30, 2021. The entire contents of this application are hereby incorporated herein by reference.

BACKGROUND OF THE INVENTION

1. Field of the Invention

The present invention relates to an outboard motor.

2. Description of the Related Art

An outboard motor described in US 2010/0167604 A1 includes an outboard motor main body, and an attaching device that attaches the outboard motor main body to a hull. The outboard motor main body includes an upper case in which an engine is housed, a drive shaft that extends downwardly from the upper case, a propeller shaft that has a rear end to which a propeller is attached, and a gear case in which a lower portion of the drive shaft and the propeller shaft are housed. A pinion gear attached to a lower end of the drive shaft, a front bevel gear and a reverse bevel gear both of which engage with the pinion gear, a clutch attached to the propeller shaft, and a shift motor that works the clutch are disposed in the gear case.

The front bevel gear and the reverse bevel gear rotate in mutually opposite directions in accordance with the rotation of the drive shaft. When the shift motor moves the clutch to the front bevel gear, the propeller shaft and the propeller rotate in a direction in which the hull moves forward. When the shift motor moves the clutch to the reverse bevel gear, the propeller shaft and the propeller rotate in an opposite direction. The clutch is a constituent of a so-called dog clutch together with the front bevel gear and the reverse bevel gear. In some cases, a slider is referred to as a dog clutch. Therefore, in this description, a member that moves in an axial direction of the propeller shaft etc., in order to transmit power is referred to as a dog clutch.

The outboard motor main body includes a coupling mechanism that couples the upper case and the gear case together. The coupling mechanism enables the gear case to freely swing rightwardly and leftwardly around the drive shaft with respect to the upper case.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

In an arrangement in which a lower unit including a gear case and elements housed in the gear case is relatively turnable with respect to a structural component disposed above the lower unit as in US 2010/0167604 A1, it is conceivable that a harness extending from the structural component is connected to an electrical component, such as the shift motor. In this situation, if the harness is exposed outwardly from the outboard motor, there is a possibility that the harness will spoil the external appearance of the outboard motor, or there is a possibility that the turnable range of the lower unit will be restricted by the harness. Therefore, consideration is required to be given to the layout of the harness.

Therefore, preferred embodiments of the present invention provide outboard motors that, in an arrangement in which a lower unit is relatively turnable with respect to a structural component disposed above the lower unit, each has a unique structure in the layout of a harness connected to an electrical component disposed in the lower unit.

In order to overcome the previously unrecognized and unsolved challenges described above, a preferred embodiment of the present invention provides an outboard motor including an engine, a drive shaft extending downwardly from the engine, a drive shaft cover to cover an upper portion of the drive shaft, a lower unit, and a harness. The drive shaft is rotated by power of the engine. The drive shaft cover is provided with an upper space extending along a circumferential direction around the drive shaft. The lower unit is joined to the drive shaft cover so as to be rotatable with respect to the drive shaft cover along the circumferential direction around a steering axis coaxial with the drive shaft. The lower unit includes a propeller, a propeller shaft to rotate together with the propeller, a transmission to transmit rotation of the drive shaft to the propeller shaft, an electrical component, and a lower housing. The lower housing houses the propeller shaft, the transmission, a lower portion of the drive shaft, and the electrical component. The lower housing is provided with a lower space communicating with the upper space from below. The harness extends through the upper space and the lower space, and is connected to the electrical component in the lower housing.

With this structural arrangement, the lower unit is rotatable around a steering axis coaxial with the drive shaft with respect to the drive shaft cover that is a structural component disposed above the lower unit in the outboard motor. Additionally, a portion (hereinafter, referred to as a "relay portion"), which straddles between the lower housing and the drive shaft cover, of the harness connected to the electrical component in the lower housing of the lower unit extends through the upper space of the drive shaft cover and through the lower space of the lower housing. The upper space extends along the circumferential direction around the drive shaft in the drive shaft cover, and the lower space communicates with the upper space from below. In this case, when the lower unit relatively turns, the relay portion of the harness is deformed so as to follow the relative turning of the lower unit within the upper space and the lower space. Thus, in the harness, it is possible to locate not only a lower portion connected to the electrical component inside the lower housing but also the relay portion in the outboard motor so as not to affect the relative turning of the lower unit. As thus described, it is possible to improve the external appearance of the outboard motor by location a portion, which is around the lower unit, of the harness in the outboard motor. Additionally, it is possible to prevent the turnable range of the lower unit from being restricted by the harness. As described above, it is possible to provide the outboard motor that has a unique structural layout of the harness connected to the electrical component in the lower unit.

In a preferred embodiment of the present invention, the lower unit is turnable within a predetermined turning range with respect to the drive shaft cover, and the upper space and the lower space communicate with each other at any turning position within the turning range.

With this structural arrangement, even if the lower unit relatively turns to any turning position within the turning range, the relay portion of the harness is deformed so as to follow the relative turning of the lower unit within the upper space and the lower space that communicate with each other. This makes it possible to locate the relay portion of the harness in the outboard motor so as not to affect the relative turning of the lower unit without giving consideration to the turning position of the lower unit.

In a preferred embodiment of the present invention, the harness extends in the circumferential direction, and is bent in the upper space and/or the lower space.

With this structural arrangement, when the lower unit relatively turns, the relay portion, which is disposed in the upper space and/or the lower space, of the harness is bent in the circumferential direction, and thus is deformed so as to follow the relative turning of the lower unit further. This makes it possible to locate the relay portion of the harness in the outboard motor so as not to affect the relative turning of the lower unit further.

In a preferred embodiment of the present invention, the lower unit is provided with an exhaust port. An exhaust passage that guides an exhaust gas emitted from the engine to the exhaust port extends across the drive shaft cover and the lower housing. The upper space and the lower space define a portion of the exhaust passage.

With this structural arrangement, a portion of the exhaust passage is used as the upper space and as the lower space, thus making it possible to locate the relay portion of the harness in the outboard motor so as not to affect the relative turning of the lower unit.

In a preferred embodiment of the present invention, the outboard motor further includes a harness cover that is provided in at least either one of the upper space and the lower space and that covers the harness.

With this structural arrangement, the relay portion of the harness, which is located in the upper space and the lower space each of which defines a portion of the exhaust passage, is covered with the harness cover, and therefore it is possible to protect the relay portion of the harness so that an exhaust gas flowing through the exhaust passage does not directly contact the relay portion.

In a preferred embodiment of the present invention, a shaft housing chamber that houses the drive shaft extends across the drive shaft cover and the lower housing. The upper space and the lower space are demarcated at a radially outward side with respect to the shaft housing chamber.

With this structural arrangement, a portion demarcated at the radially outward side with respect to the shaft housing chamber is used as the upper space and as the lower space, thus making it possible to locate the relay portion of the harness in the outboard motor so as not to affect the relative turning of the lower unit.

In a preferred embodiment of the present invention, a cooling water passage through which cooling water flows to cool the engine extends across the drive shaft cover and the lower housing, and the upper space and the lower space define a portion of the cooling water passage.

With this structural arrangement, a portion of the cooling water passage is used as the upper space and as the lower space, thus making it possible to locate the relay portion of the harness in the outboard motor so as not to affect the relative turning of the lower unit.

In a preferred embodiment of the present invention, the transmission includes a rotary body that rotates interlockingly with rotation of the drive shaft, and a dog clutch that rotates interlockingly with the propeller shaft. The dog clutch is movable between a connection position in which the dog clutch engages with the rotary body and a disconnection position in which the dog clutch is disconnected from the rotary body. The electrical component includes a shift actuator that moves the dog clutch.

With this structural arrangement, in a state in which the dog clutch that rotates interlockingly with the propeller shaft is in the disconnection position and spaced apart from the rotary body, the rotary body that rotates interlockingly with the rotation of the drive shaft runs idle, and therefore the rotation of the drive shaft is not transmitted to the propeller shaft. When the dog clutch moves from the disconnection position to the connection position and engages with the rotary body, the outboard motor is shifted in. Thereupon, the rotation of the drive shaft is transmitted to the propeller shaft through the rotary body and the dog clutch, and, as a result, the propeller shaft rotates together with the propeller, and therefore the propeller generates a thrust. In an example in which the electrical component disposed in the lower unit is a shift actuator that moves the dog clutch, it is possible to provide the outboard motor that has a unique structural layout of the harness connected to the shift actuator as described above.

In a preferred embodiment of the present invention, the upper space and the lower space are each an annular space extending along the circumferential direction.

With this structural arrangement, the lower space always communicates with the upper space from below even if the turning range of the lower unit is set at 360 degrees or more and even if the lower unit relatively turns to any turning position within this turning range. Therefore, the relay portion of the harness is deformed so as to follow the relative turning of the lower unit in a state in which the relay portion of the harness is always located in the upper space and the lower space. This makes it possible to locate the relay portion of the harness in the outboard motor so as not to affect the relative turning of the lower unit without giving consideration to the turning position of the lower unit.

In a preferred embodiment of the present invention, the harness includes a first harness connected to the electrical component disposed in the lower housing through the lower space, and a second harness that is disposed outside the lower housing through the upper space. The second harness is connected to the first harness through a connector. An outer wall of the lower housing includes an insertion hole that communicates with the lower space and into which the first harness is inserted. The outboard motor further includes a seal that seals a gap around the first harness in the insertion hole.

With this structural arrangement, an operator is able to complete the harness by connecting the first harness and the second harness together by use of the connector. A gap around the first harness in the insertion hole provided in the outer wall of the lower housing is sealed with the seal, and therefore it is possible to prevent water around the outboard motor from entering the lower housing through the gap.

In a preferred embodiment of the present invention, the seal includes a plurality of arc-shaped grommets around the first harness in the insertion hole. The outboard motor further includes a pushing member that pushes the grommets into the insertion hole.

With this structural arrangement, the grommets that have been pushed by the pushing member are pressed and fitted into the gap around the first harness in the insertion hole in a state in which the mutually adjoining grommets are in close contact with each other. Therefore, it is possible to prevent water around the outboard motor from entering the lower housing through the gap.

In a preferred embodiment of the present invention, the outboard motor further includes a steering actuator in an upper unit along with the engine and the drive shaft cover to turn the lower unit around the steering axis, and the upper unit is above the lower unit.

With this structural arrangement, the steering actuator allows the lower unit to turn with respect to the upper unit. The steering actuator is provided not at the lower unit but at the upper unit, thus making it possible to reduce the number of electrical components in the lower unit. This makes it possible to reduce or minimize the number of harnesses that are to be connected to electrical components disposed in the lower unit.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
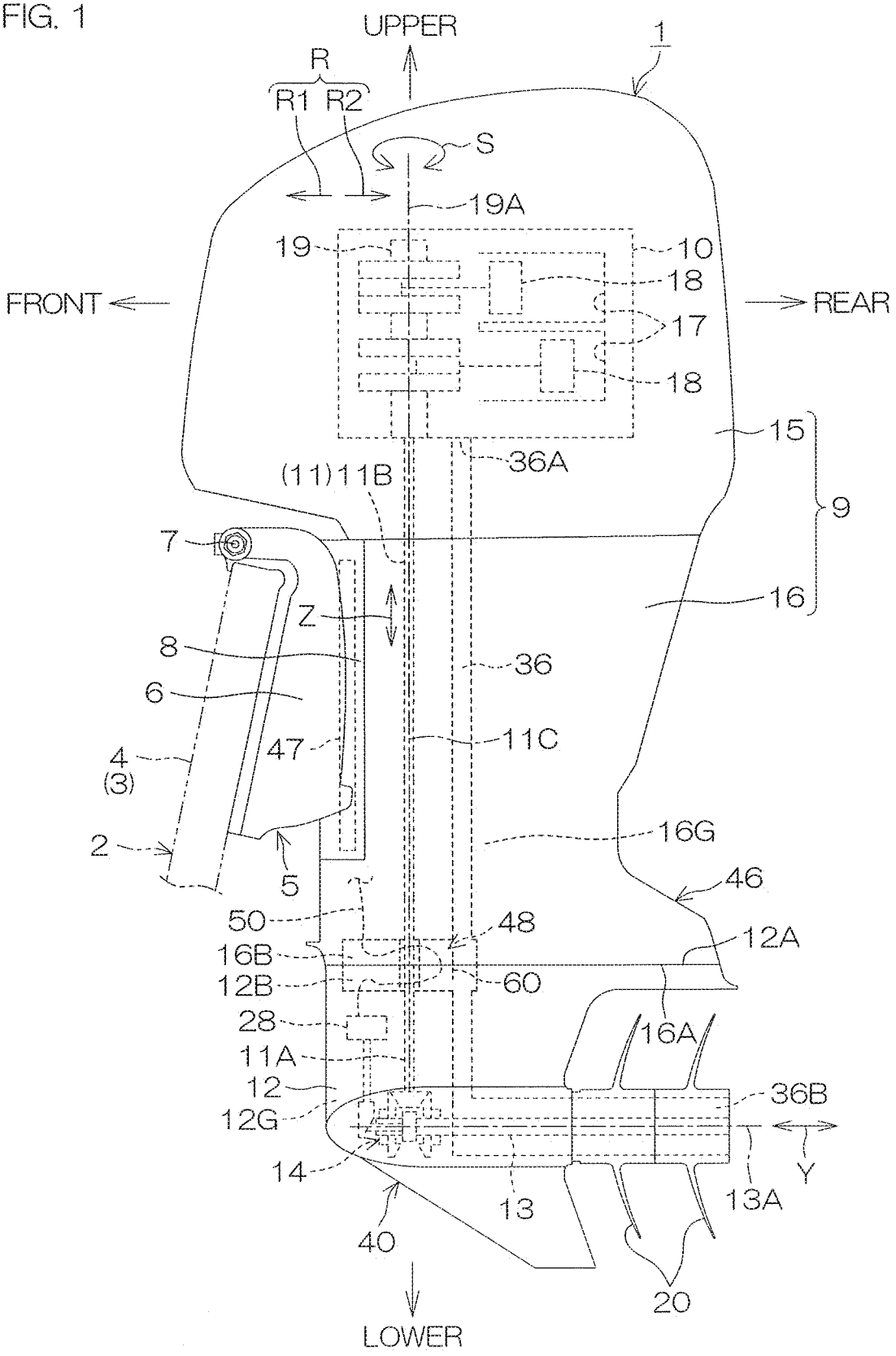
FIG. 1 is a schematic side view of an outboard motor according to a preferred embodiment of the present invention.

FIG. 1 is a schematic side view of an outboard motor 1 according to a preferred embodiment of the present invention. The left side in FIG. 1 is the front side of the outboard motor 1, and the right side in FIG. 1 is the rear side of the outboard motor 1. The near side in a direction perpendicular to the plane of paper of FIG. 1 is the left side of the outboard motor 1, and the far side in the direction perpendicular to the plane of paper of FIG. 1 is the right side of the outboard motor 1.

The outboard motor 1 is attached to a transom 4 of a hull 3 of a vessel 2 through an attachment mechanism 5. The attachment mechanism 5 includes a clamp bracket 6 fixed to the transom 4, a swivel bracket 8 coupled to the clamp bracket 6 through a tilt shaft 7 horizontally extending in a left-right direction. The swivel bracket 8 is fixed to the outboard motor 1. Thus, the outboard motor 1 is attached to the transom 4 by the attachment mechanism 5 in a vertical or substantially vertical attitude. The attachment mechanism 5 may be regarded as an element of the outboard motor 1. The outboard motor 1 and the swivel bracket 8 are turnable in an up-down direction around the tilt shaft 7 with respect to the clamp bracket 6. The outboard motor 1 is turned around the tilt shaft 7, and, as a result, the outboard motor 1 is tilted with respect to the hull 3 and with respect to the clamp bracket 6.

The outboard motor 1 includes an upper housing 9 having a vertically elongated box shape, an engine 10 disposed in the upper housing 9, and a drive shaft 11 extending downwardly from the engine 10 in the upper housing 9. The outboard motor 1 includes a hollow lower housing 12 disposed under the upper housing 9 and a propeller shaft 13 and a transmission 14 both of which are disposed in the lower housing 12.

The upper housing 9 includes an engine cover 15 occupying a substantially upper half and a drive shaft cover 16 occupying a substantially lower half. The engine cover 15 has a box shape and houses the engine 10. The drive shaft cover 16 has a cylindrical shape extending in the up-down direction, and covers most of the drive shaft 11, i.e., covers an upper portion 11B higher than a lower portion 11A in the drive shaft 11. The engine cover 15 and the drive shaft cover 16 may be integral with each other, or may be mutually different components combined and united together. The drive shaft cover 16 will be described in detail below.

The engine 10 is an internal combustion engine that burns fuel, such as gasoline, so as to generate power, and contains a combustion chamber 17, a piston 18 disposed in the combustion chamber 17, and a crank shaft 19 coupled to the piston 18. The crank shaft 19 has a crankshaft axis 19A extending in the up-down direction. A lower end portion of the crank shaft 19 is coupled to an upper end portion of the drive shaft 11. The combustion of an air-fuel mixture in the combustion chamber 17 enables the piston 18 to rectilinearly reciprocate in a front-rear direction perpendicular to the crankshaft axis 19A.

The drive shaft 11 extends along the up-down direction between the propeller shaft 13 and the engine 10. Therefore, an axial direction Z of the drive shaft 11 is the up-down direction. When the piston 18 rectilinearly reciprocates, the crank shaft 19 is driven and rotated around the crankshaft axis 19A along with the drive shaft 11. In other words, the drive shaft 11 is rotated by the power of the engine 10. The rotation direction of the crank shaft 19 and the rotation direction of the drive shaft 11 are, for example, clockwise directions, respectively, in a plan view seen from above, and a central axis 11C of the drive shaft 11 coincides with the crankshaft axis 19A.

In the following description, a radial direction based on the central axis 11C is referred to as a radial direction R of the drive shaft 11. The outward side in the radial direction R (hereinafter, referred to as a "radially outward side R1") is a directional side away from the central axis 11C, whereas the inward side of the radial direction R (hereinafter, referred to as a "radially inward side R2") is a directional side approaching the central axis 11C. Additionally, the circumferential direction around the drive shaft 11 is referred to as a "circumferential direction S."

The lower housing 12 houses the lower portion 11A of the drive shaft 11 in addition to the propeller shaft 13 and the transmission 14. The lower housing 12 will be described in detail below.

Figure 2:
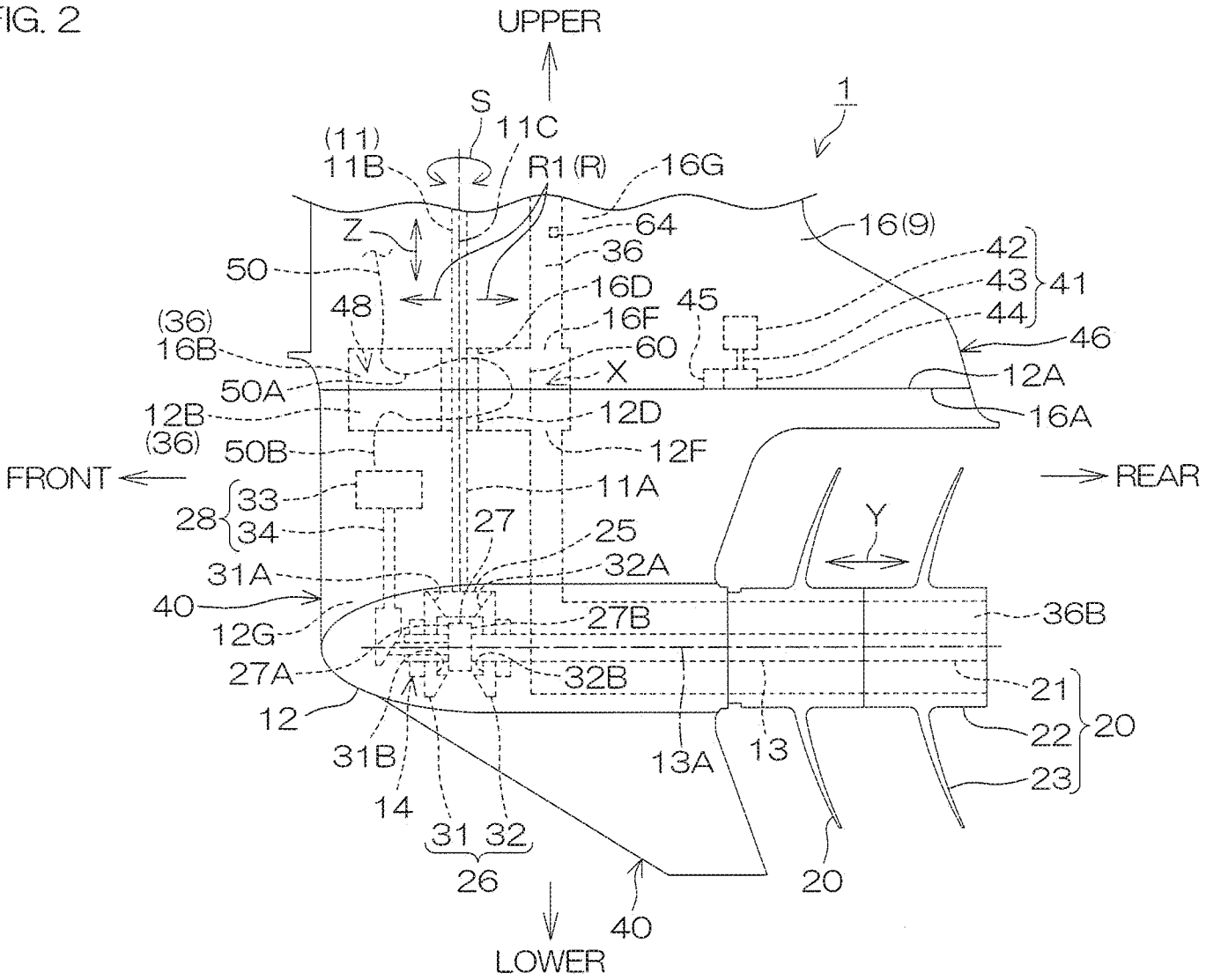
FIG. 2 is a side view of a lower portion of the outboard motor.

FIG. 2 is a left side view of a lower portion of the outboard motor 1. The propeller shaft 13 extends in the front-rear direction in the lower housing 12. Therefore, an axial direction Y of the propeller shaft 13 is the front-rear direction. A lower end portion of the drive shaft 11 is coupled to a front end portion of the propeller shaft 13 by the transmission 14. A rear end portion of the propeller shaft 13 protrudes rearwardly from the lower housing 12.

A single or a plurality of propellers 20 is/are attached to the rear end portion of the propeller shaft 13. If a plurality of propellers 20 are provided, the propellers 20 are disposed side by side in the front-rear direction. Each of the propellers 20 includes an inner cylinder 21 fixed to the rear end portion of the propeller shaft 13, an outer cylinder 22 that has a circular cylindrical shape and that surrounds the inner cylinder 21, a plurality of ribs (not shown) that connect an outer peripheral surface of the inner cylinder 21 and an inner peripheral surface of the outer cylinder 22 together, and a plurality of blades 23 provided at an outer peripheral surface of the outer cylinder 22. The propeller shaft 13 rotates together with the propeller 20 around a rotational axis 13A that extends in the front-rear direction.

The transmission 14 transmits the rotation of the drive shaft 11 to the propeller shaft 13. The transmission 14 includes a driving gear 25 fixed to the lower end portion of the drive shaft 11, and a rotary body 26 and a dog clutch 27 both of which are attached to the front end portion of the propeller shaft 13. The transmission 14 additionally includes an electric shift actuator 28 that is housed in the lower housing 12 and that is disposed at a more forward position than the propeller shaft 13.

The driving gear 25 is a bevel gear. The propeller shaft 13 is disposed below the driving gear 25. The rotary body 26 includes a first rotary body 31 and a second rotary body 32 that are disposed side by side in the front-rear direction along the propeller shaft 13. The first rotary body 31 and the second rotary body 32 are, for example, cylindrical bevel gears, respectively.

In the present preferred embodiment, the first rotary body 31 is disposed at a more forward position than the driving gear 25, and the second rotary body 32 is disposed at a more rearward position than the driving gear 25, but the front-rear positional relationship between the first rotary body 31 and the second rotary body 32 may be opposite to that of the present preferred embodiment. In a rear surface of the first rotary body 31, a tooth portion 31A is provided at its outer peripheral portion having a tapered shape, and a claw portion 31B is provided at its inner peripheral portion. In a front surface of the second rotary body 32, a tooth portion 32A is provided at its outer peripheral portion having a tapered shape, and a claw portion 32B is provided at its inner peripheral portion.

In the front end portion of the propeller shaft 13, the first rotary body 31 surrounds a portion at a more forward position than the driving gear 25, and, in the front end portion of the propeller shaft 13, the second rotary body 32 surrounds a portion at a more rearward position than the driving gear 25. The first rotary body 31 and the second rotary body 32 are disposed so that their tooth portions 31A and 32A face each other with an interval between the tooth portions 31A and 32A in the front-rear direction, and engage with the driving gear 25. When the driving gear 25 rotates together with the drive shaft 11 in response to the driving of the engine 10, the rotation of the driving gear 25 is transmitted to the first rotary body 31 and the second rotary body 32. Thus, the first rotary body 31 and the second rotary body 32 rotate in mutually opposite directions around the rotational axis 13A of the propeller shaft 13. As thus described, the rotary body 26 (the first rotary body 31 and the second rotary body 32) engaging with the driving gear 25 rotates interlockingly with the rotation of the drive shaft 11.

The dog clutch 27 is disposed between the first rotary body 31 and the second rotary body 32. The dog clutch 27 is, for example, cylindrical, and surrounds the front end portion of the propeller shaft 13. A first claw portion 27A is provided at a front end surface of the dog clutch 27, and a second claw portion 27B is provided at a rear end surface of the dog clutch 27. The dog clutch 27 is coupled to the front end portion of the propeller shaft 13 by, for example, a spline (not shown). Therefore, the dog clutch 27 rotates together with the front end portion of the propeller shaft 13. In other words, the dog clutch 27 rotates interlockingly with the propeller shaft 13. Additionally, the dog clutch 27 is movable in the front-rear direction with respect to the front end portion of the propeller shaft 13. In other words, the dog clutch 27 is rotatable together with the propeller shaft 13 and is movable along the front-rear direction relatively with the propeller shaft 13.

The shift actuator 28 is an electrical component that includes an electric motor 33 and a shift rod 34 that is coupled to an output shaft (not shown) of the motor 33 and that extends downwardly. A lower end portion of the shift rod 34 is coupled to the dog clutch 27. When the motor 33 is activated, the shift rod 34 turns around an axis of the shift rod 34. The dog clutch 27 is moved in the front-rear direction between a disconnection position and a connection position by allowing the shift rod 34 to turn.

The disconnection position is a position in which the dog clutch 27 is disconnected from the first rotary body 31 and the second rotary body 32 and engages with neither of the rotary bodies 26 as shown in FIG. 2. In a state in which the dog clutch 27 is placed in the disconnection position, each rotary body 26 to which the rotation of the drive shaft 11 is transmitted runs idle, and therefore the rotation of the drive shaft 11 is not transmitted to the propeller shaft 13. The shift position of the outboard motor 1 at this time is hereinafter referred to as "neutral."

The connection position is a position in which the dog clutch 27 engages with either one of the first rotary body 31 and the second rotary body 32. The connection position includes a first connection position in which the first claw portion 27A of the dog clutch 27 engages with only the claw portion 31B of the first rotary body 31 and a second connection position in which the second claw portion 27B of the dog clutch 27 engages with only the claw portion 32B of the second rotary body 32. The disconnection position is a position between the first connection position and the second connection position. The first connection position is more forward than the disconnection position, and the second connection position is more rearward than the disconnection position.

In a state in which the dog clutch 27 is placed in the first connection position and is coupled to only the first rotary body 31, the rotation of the first rotary body 31 is transmitted to the propeller shaft 13, and therefore the shift position of the outboard motor 1 is shifted into "forward." Thereupon, the rotation of the drive shaft 11 is transmitted to the propeller shaft 13 through the first rotary body 31 and the dog clutch 27, and, as a result, the propeller 20 rotates in a forward rotational direction (for example, in a clockwise direction when seen from the rear side). Thus, the blades 23 of the propeller 20 generate a forward thrust.

In a state in which the dog clutch 27 is placed in the second connection position and is coupled to only the second rotary body 32, the rotation of the second rotary body 32 is transmitted to the propeller shaft 13, and therefore the shift position of the outboard motor 1 is shifted into "reverse." Thereupon, the rotation of the drive shaft 11 is transmitted to the propeller shaft 13 through the second rotary body 32 and the dog clutch 27, and, as a result, the propeller 20 rotates in a reverse rotational direction opposite to the forward rotational direction. Thus, the blades 23 of the propeller 20 generate a reverse thrust. Thus, in the present preferred embodiment, the first rotary body 31 is a gear for a forward movement, and the second rotary body 32 is a gear for a reverse movement. Of course, the first rotary body 31 may be a gear for a reverse movement, and the second rotary body 32 may be a gear for a forward movement.

The outboard motor 1 includes an exhaust passage 36 extending across the lower housing 12 and the drive shaft cover 16 inside the outboard motor 1. The exhaust passage 36 is disposed, for example, at a more rearward position than the drive shaft 11, and extends in the up-down direction. An upper end 36A of the exhaust passage 36 is connected to the engine 10 (see FIG. 1). The exhaust passage 36 includes an exhaust port 36B provided in the propeller 20. A gap between the inner cylinder 21 and the outer cylinder 22 in the propeller 20 defines a portion of the exhaust passage 36, and an opening of a rear end surface of the outer cylinder 22 of a rearmost propeller 20 defines the exhaust port 36B of the exhaust passage 36.

In a state in which the vessel 2 is floating on water so that the propeller 20 is located at a lower position than a water surface, the exhaust port 36B is located in the water, and therefore water that has passed through the exhaust port 36B enters a downstream portion of the exhaust passage 36. On the other hand, when the engine 10 rotates at a high speed, water in the exhaust passage 36 is pushed by the pressure of an exhaust gas emitted from the engine 10, and is guided to the exhaust port 36B by the exhaust passage 36 together with the exhaust gas, and is discharged from the exhaust port 36B. Thus, the exhaust gas generated in the engine 10 is discharged into the water.

The lower housing 12, the propeller shaft 13, the transmission 14, and the shift actuator 28, which are housed in the lower housing 12, and the propeller 20 exposed rearwardly from the lower housing 12 define a lower unit 40. The lower unit 40 is joined to the drive shaft cover 16 so as to be relatively rotatable with respect to the drive shaft cover 16 along the circumferential direction S around a steering axis extending in the up-down direction. The steering axis is coaxial with the drive shaft 11, and, strictly speaking, the steering axis coincides with the central axis 11C of the drive shaft 11. In other words, the central axis 11C can be regarded as a steering axis. The lower unit 40 is relatively turnable within a predetermined turning range with respect to the drive shaft cover 16.

The outboard motor 1 includes an electric steering actuator 41 that relatively turns the lower unit 40 around the central axis 11C with respect to the drive shaft cover 16. An example of the steering actuator 41 includes a motor 42 provided at the drive shaft cover 16 and a pinion gear 44 attached to an output shaft 43 that protrudes downwardly from the motor 42. The pinion gear 44 is exposed to a lower surface of a lower wall 16A that is part of an outer wall of the drive shaft cover 16. A rack gear 45 extending along the circumferential direction S is provided at an upper surface of an upper wall 12A that is part of an outer wall of the lower housing 12, and the pinion gear 44 engages with the rack gear 45. When the motor 33 is activated, the lower unit 40 is turned by the rotation of the output shaft 43 and the rotation of the pinion gear 44. Another arrangement may be used as the steering actuator 41 (which will be described in detail below). Additionally, in each of the drawings other than FIG. 2, the steering actuator 41 is omitted and is not shown.

The upper housing 9 including the drive shaft cover 16, the engine 10, and the steering actuator 41 define an upper unit 46 that is a structural component located at a higher position than the lower unit 40. In the present preferred embodiment, the upper unit 46 is fixed to the swivel bracket 8, and thus cannot turn in the left-right direction, and therefore only the lower unit 40 solely turns in the left-right direction in the outboard motor 1. As another example, the upper unit 46 may be coupled to the swivel bracket 8 through a steering shaft 47 (see FIG. 1) extending in the up-down direction, and may be turnable in the left-right direction around the steering shaft 47. In this case, both the upper unit 46 and the lower unit 40 are able to turn individually.

Figure 3:
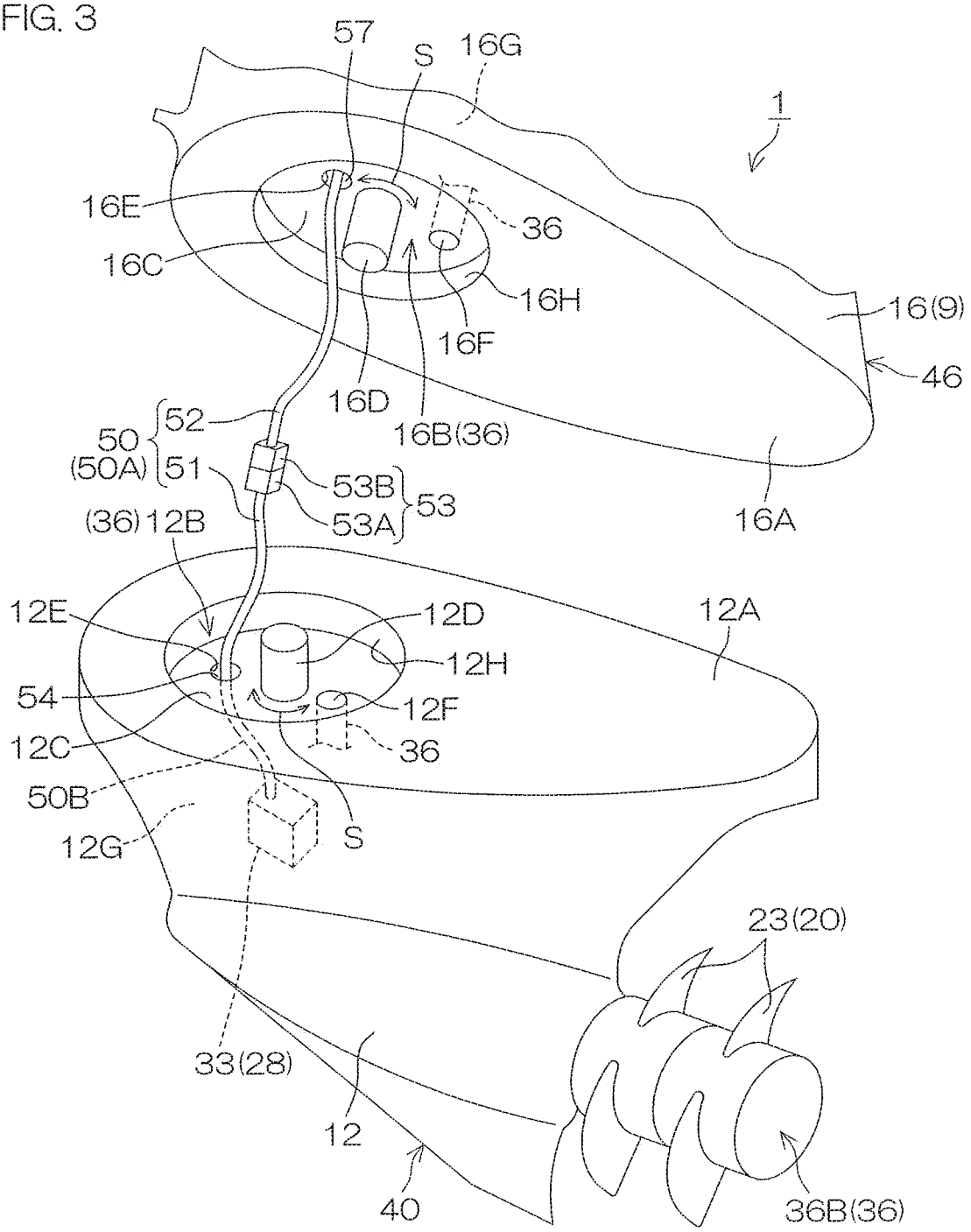
FIG. 3 is an exploded perspective view of the lower portion of the outboard motor.

FIG. 3 is an exploded perspective view of the lower portion of the outboard motor 1. An upper space 16B is provided in a region closer to the front side in the lower surface of the drive shaft cover 16 of the lower wall 16A. The upper space 16B is an annular space (more specifically, a circular annular space) extending along the circumferential direction S and is hollowed upwardly from the lower surface of the lower wall 16A. A circular annular top surface 16C that closes the upper space 16B from above is provided at the drive shaft cover 16. The top surface 16C is part of the lower wall 16A. A circular tubular upper pipe 16D extending downwardly while fringing an inner peripheral edge of the top surface 16C is provided at the center of the top surface 16C.

An insertion hole 16E and an inlet 16F that communicate with the upper space 16B from above are provided in the top surface 16C so as to be spaced apart from each other in the circumferential direction S. The insertion hole 16E is disposed at a more forward position than the inlet 16F. An internal space of the upper pipe 16D and the insertion hole 16E each communicate with the inside of the drive shaft cover 16, i.e., communicate with an internal space 16G of the drive shaft cover 16 from below. A portion, located in the drive shaft cover 16, of the exhaust passage 36 extends upwardly from the inlet 16F.

A lower space 12B is provided in a region closer to the front side in the upper surface of the upper wall 12A of the lower housing 12. The lower space 12B is an annular space (more specifically, a circular annular space) extending along the circumferential direction S and is hollowed downwardly from the upper wall 12A. A circular annular bottom surface 12C that closes the lower space 12B from below is provided at the lower housing 12. The bottom surface 12C is part of the upper wall 12A. A circular tubular lower pipe 12D extending upwardly while fringing an inner peripheral edge of the bottom surface 12C is provided at the center of the bottom surface 12C.

An insertion hole 12E and an outlet 12F that communicate with the lower space 12B from below are provided in the bottom surface 12C so as to spaced apart from each other in the circumferential direction S. The insertion hole 12E is disposed at a more forward position than the outlet 12F. An internal space of the lower pipe 12D and the insertion hole 12E each communicate with the inside of the lower housing 12, i.e., communicate with an internal space 12G of the lower housing 12 from above. A portion, located in the lower housing 12, of the exhaust passage 36 extends downwardly from the outlet 12F.

In a state in which the outboard motor 1 has been completed by incorporating the lower unit 40 into the upper unit 46, the lower space 12B faces the upper space 16B from below and communicates with the upper space 16B (see FIG. 2). The upper space 16B and the lower space 12B in communication with each other are united together as an annular relay space 48 that relays the inlet 16F of the drive shaft cover 16 and the outlet 12F of the lower housing 12 to each other, and thus define a portion of the exhaust passage 36. Additionally, the internal space of the upper pipe 16D and the internal space of the lower pipe 12D communicate with each other, and the drive shaft 11 extends through these internal spaces (see FIG. 2). It is preferable to make the upper space 16B and the lower space 12B equal or substantially equal in diameter (the inner diameter of a circular cylindrical surface 16H of the upper space 16B and the inner diameter of a circular cylindrical surface 12H of the lower space 12B), but may be equal to each other or may be different from each other in size in the up-down direction. The relay space 48 may be sealed, or water that has passed through a space between the upper wall 12A of the lower housing 12 and the lower wall 16A of the drive shaft cover 16 from the surroundings of the outboard motor 1 may flow into the relay space 48.

The outboard motor 1 includes a harness 50 connected to the shift actuator 28 and disposed in the lower housing 12 through the upper space 16B and the lower space 12B. The harness 50 includes at least either one of a signal wire and a power supply wire. The harness 50 includes a first harness 51 connected to the shift actuator 28 disposed in the lower housing 12 through the lower space 12B, and a second harness 52 that extends through the upper space 16B and that is disposed outside the lower housing 12. The second harness 52 is connected to the first harness 51 through a connector 53.

The connector 53 includes a first connector 53A on the first harness 51 side and a second connector 53B on the second harness 52 side. An operator is able to complete the harness 50 by coupling the first connector 53A and the second connector 53B together and then connecting the first harness 51 and the second harness 52 together. The first harness 51 is inserted into the insertion hole 12E in the lower space 12B of the lower housing 12, is then drawn into the internal space 12G of the lower housing 12, and is connected to the shift actuator 28. The second harness 52 is inserted into the insertion hole 16E in the upper space 16B of the drive shaft cover 16, is then drawn into the internal space 16G of the drive shaft cover 16, and is connected to an electronic control unit (not shown), a battery (not shown), and the like of the outboard motor 1. The connector 53 may be disposed in the lower space 12B and/or the upper space 16B.

Figure 4:
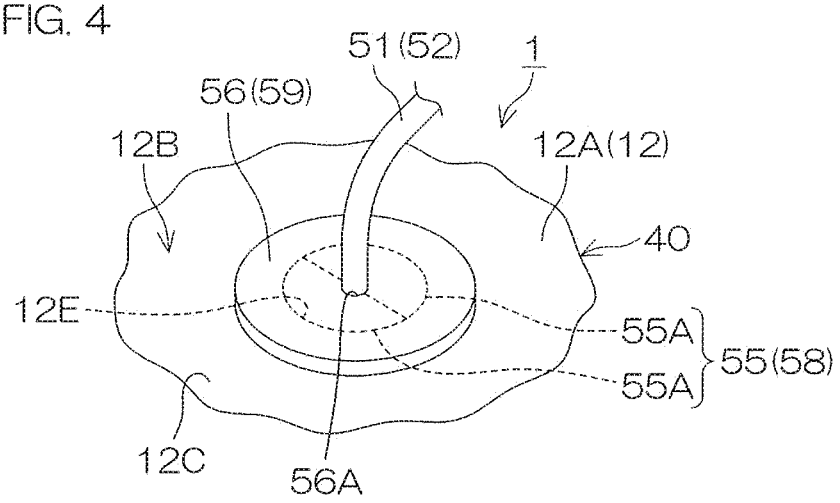
FIG. 4 is a perspective view of a main portion of the lower portion of the outboard motor.
Figure 5:
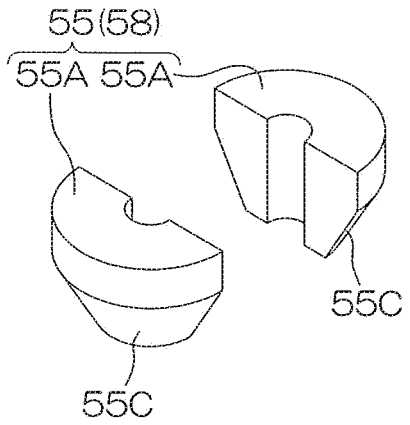
FIG. 5 is an exploded perspective view of the main portion of the lower portion of the outboard motor.
Figure 6:
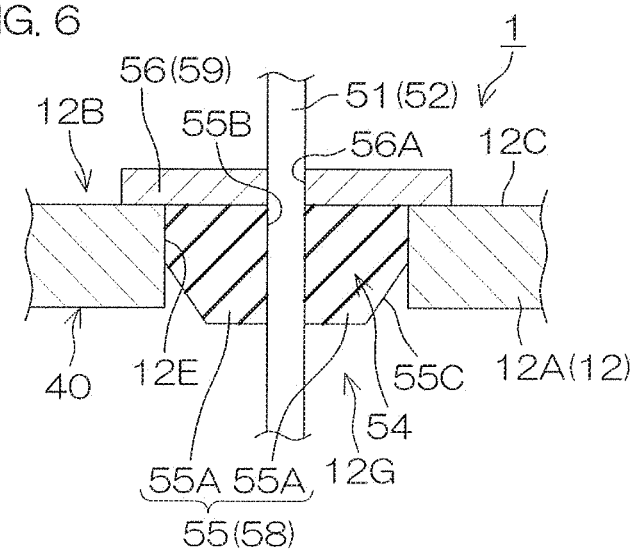
FIG. 6 is a longitudinal sectional view of the main portion of the lower portion of the outboard motor.

FIG. 4 is a perspective view of a portion, which surrounds the first harness 51, of the lower portion of the outboard motor 1. The outboard motor 1 includes a sealing member 55 that seals a gap 54 (see FIG. 3) around the first harness 51 in the insertion hole 12E of the lower housing 12 and a pushing member 56 that pushes the sealing member 55 into the insertion hole 12E. The sealing member 55 is made of rubber or resin, for example, and includes a plurality of grommets 55A. Each of the grommets 55A has a circular arc shape in a plan view (see FIG. 5). In the present preferred embodiment, a circular cylindrical sealing member 55 is formed by combining two grommets 55A together so as to sandwich the first harness 51 between the two grommets 55A. The sealing member 55 has a through hole 55B extending through the center of the sealing member 55, and the first harness 51 sandwiched between the two grommets 55A extends through the through hole 55B (see FIG. 6). Therefore, the grommets 55A are disposed around the first harness 51 in the insertion hole 12E. A lower end portion of an outer peripheral surface of the sealing member 55 has a tapered surface 55C that is thinner as it extends downwardly. This enables the operator to smoothly fit the sealing member 55 into the insertion hole 12E.

An example of the pushing member 56 is a circular ring that is made of metal, for example, and includes a washer or the like. The pushing member 56 is disposed in the lower space 12B of the lower housing 12. The pushing member 56 is fixed to the bottom surface 12C of the lower space 12B by a fastening member, such as a bolt and a nut, (not shown), and pushes the sealing member 55, i.e., pushes the two grommets 55A into the insertion hole 12E from above (see FIG. 6). The first harness 51 is inserted into a central hole 56A of the pushing member 56.

As thus described, a gap 54 around the first harness 51 in the insertion hole 12E provided in the upper wall 12A of the lower housing 12 is sealed with the sealing member 55. Particularly, the grommets 55A that have been pushed by the pushing member 56 are pressed and fitted into the gap 54 around the first harness 51 in the insertion hole 12E in a state in which the mutually adjoining grommets 55A are in close contact with each other. Therefore, it is possible to prevent water, which has entered the lower space 12B from around the outboard motor 1 through a space between the upper wall 12A of the lower housing 12 and the lower wall 16A of the drive shaft cover 16, from entering the internal space 12G of the lower housing 12 through the gap 54.

The outboard motor 1 includes a sealing member 58 that seals a gap 57 (see FIG. 3) around the second harness 52 in the insertion hole 16E of the drive shaft cover 16 and a pushing member 59 that pushes the sealing member 58 into the insertion hole 16E. The sealing member 58 may have a structure similar to the sealing member 55 described above, and the pushing member 59 may have a structure similar to the pushing member 56 described above.

Figure 7:
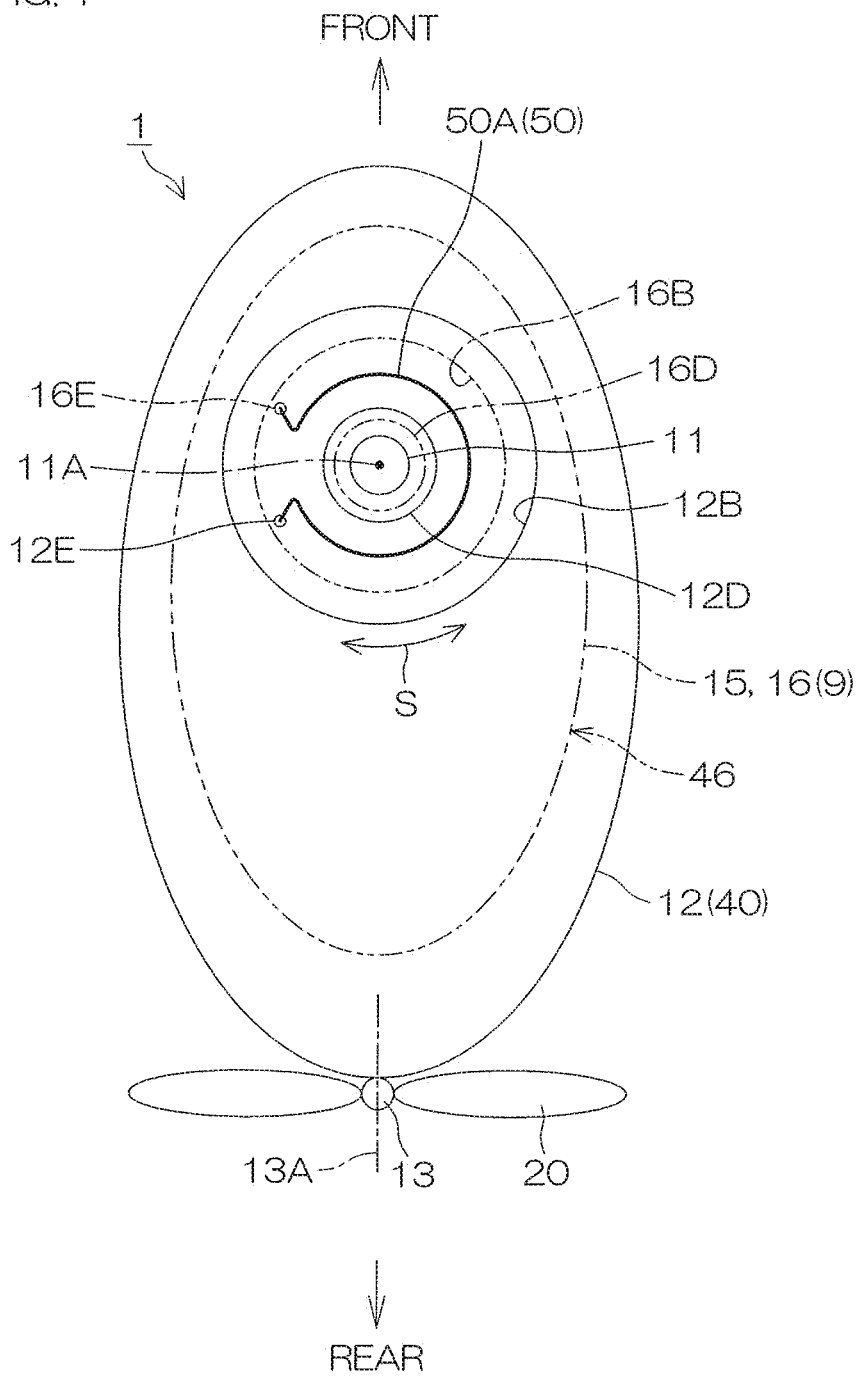
FIG. 7 is a schematic plan view of a main portion of the outboard motor.

FIG. 7 is a schematic plan view of a main portion of the outboard motor 1. For convenience, the lower unit 40 shown by the solid line is represented so as to be seen slightly larger than the upper unit 46 shown by the alternate long and two short dashed line in FIG. 7. The lower unit 40 of FIG. 7 is in a neutral position in which its turning angle is zero. When the lower unit 40 is in the neutral position, the rotational axis 13A of the propeller shaft 13 extends in the front-rear direction, and the rotational axis 13A in this state is parallel with a center line passing through the center of the hull 3 in the left-right direction (see FIG. 1). The harness 50 extends in the circumferential direction S and is bent in the upper space 16B and/or the lower space 12B. The harness 50 may surround the drive shaft 11 one time or more.

Figure 8:
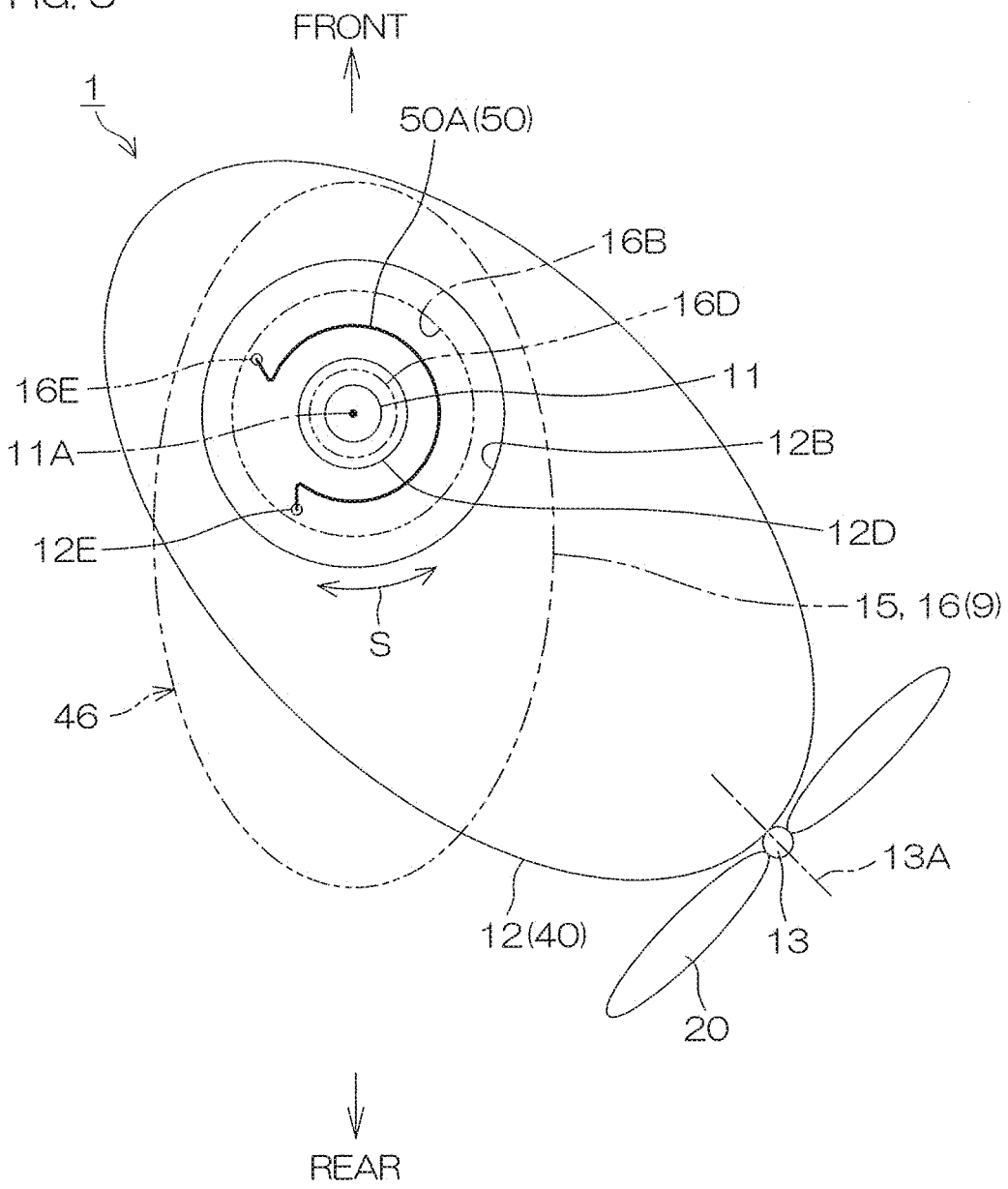
FIG. 8 is a schematic plan view of the main portion of the outboard motor.

FIG. 8 shows the outboard motor 1 when the lower unit 40 turns rightwardly from the neutral position, for example, thirty degrees. Even if the lower unit 40 is in the neutral position or even if the lower unit 40 turns from the neutral position, the lower space 12B continuously faces the upper space 16B from below and communicates with the upper space 16B. In other words, the upper space 16B and the lower space 12B communicate with each other even if the lower unit 40 is in any turning position within a turning range.

As described above, according to the present preferred embodiment, a relay portion 50A, which straddles between the lower housing 12 and the drive shaft cover 16, of the harness 50 extends through the upper space 16B of the drive shaft cover 16 and through the lower space 12B of the lower housing 12. The upper space 16B extends along the circumferential direction S around the drive shaft 11 in the drive shaft cover 16, and the lower space 12B communicates with the upper space 16B from below. In this case, when the lower unit 40 relatively turns, the relay portion 50A of the harness 50 is deformed so as to follow the relative turning of the lower unit 40 within the upper space 16B and the lower space 12B.

Thus, in the harness 50, it is possible to located not only a lower portion 50B (see FIG. 2) connected to the shift actuator 28 inside the lower housing 12 but also the relay portion 50A in the outboard motor 1 so as not to affect the relative turning of the lower unit 40. As thus described, it is possible to improve the external appearance of the outboard motor 1 by placing a portion, which is around the lower unit 40, of the harness 50 in the outboard motor 1. Additionally, it is possible to prevent the turnable range of the lower unit 40 from being restricted by the harness 50. As described above, it is possible to provide the outboard motor 1 that has a unique structure by laying out the harness 50 connected to the shift actuator 28 in the lower unit 40. Additionally, if the shift actuator 28 is provided at the upper unit 46, a complicated mechanism used to mechanically transmit the power of the shift actuator 28 from the upper unit 46 to the lower unit 40 is needed. However, in the present preferred embodiment, the shift actuator 28 is provided at the lower unit 40, and therefore such a mechanism is not needed.

In a preferred embodiment of the present invention, even if the lower unit 40 relatively turns to any turning position within the turning range, the relay portion 50A of the harness 50 is deformed so as to follow the relative turning of the lower unit 40 within the upper space 16B and the lower space 12B that communicate with each other. This makes it possible to locate the relay portion 50A of the harness 50 in the outboard motor 1 so as not to affect the relative turning of the lower unit 40 without giving consideration to the turning position of the lower unit 40.

In a preferred embodiment of the present invention, the harness 50 extends in the circumferential direction S and is bent in the upper space 16B and/or the lower space 12B. With this arrangement, when the lower unit 40 relatively turns, the relay portion 50A, which is disposed in the upper space 16B and/or the lower space 12B, of the harness 50 is bent in the circumferential direction S, and thus is deformed so as to follow the relative turning of the lower unit 40. This makes it possible to locate the relay portion 50A of the harness 50 in the outboard motor 1 so as not to affect the relative turning of the lower unit 40.

In a preferred embodiment of the present invention, the upper space 16B and the lower space 12B define a portion of the exhaust passage 36 (see FIG. 2). With this arrangement, a portion of the exhaust passage 36 is used as the upper space 16B and as the lower space 12B, thus making it possible to locate the relay portion 50A of the harness 50 in the outboard motor 1 so as not to affect the relative turning of the lower unit 40.

In this case, it is recommended to provide a harness cover 60 (see FIG. 2) covering the harness 50 in at least either one of the upper space 16B and the lower space 12B. The harness cover 60 is a partition that isolates the harness 50 from a space X (see FIG. 2) sandwiched between the outlet 12F and the inlet 16F in the upper space 16B and the lower space 12B. With this arrangement, the relay portion 50A of the harness 50, which is located in the upper space 16B and the lower space 12B each of which defines a portion of the exhaust passage 36, is covered with the harness cover 60, and therefore it is possible to protect the relay portion 50A of the harness 50 so that an exhaust gas flowing through the space X in the exhaust passage 36 does not directly contact the relay portion 50A.

In a preferred embodiment of the present invention, the upper space 16B and the lower space 12B are each an annular space extending in the circumferential direction S. With this arrangement, the lower space 12B always communicates with the upper space 16B from below even if the turning range of the lower unit 40 is set at 360 degrees or more and even if the lower unit 40 relatively turns to any turning position within this turning range. Therefore, the relay portion 50A of the harness 50 is deformed so as to follow the relative turning of the lower unit 40 in a state in which the relay portion 50A of the harness 50 is always located in the upper space 16B and the lower space 12B. This makes it possible to locate the relay portion 50A of the harness 50 in the outboard motor 1 so as not to affect the relative turning of the lower unit 40 without giving consideration to the turning position of the lower unit 40.

In a preferred embodiment of the present invention, the steering actuator 41 is provided not at the lower unit 40 but at the upper unit 46 (see FIG. 2), thus making it possible to reduce the number of electrical components in the lower unit 40. This makes it possible to reduce or minimize the number of harnesses 50 that are to be connected to electrical components in the lower unit 40.

In the above-described preferred embodiments, the upper space 16B and the lower space 12B define a portion of the exhaust passage 36. In other words, the upper space 16B and the lower space 12B achieve an advantageous use of space in the outboard motor 1, i.e., by being a portion of the exhaust passage 36. Therefore, there is no need to provide a dedicated space for the upper space 16B and the lower space 12B in the outboard motor 1, and therefore it is possible to prevent an increase in size of the outboard motor 1.

If the space other than the exhaust passage 36 exists in the outboard motor 1, the upper space 16B and the lower space 12B may be arranged as in a first modification of a preferred embodiment of the present invention and a second modification of a preferred embodiment of the present invention that are described as follows. With respect to the first and second modifications, the same reference number is given to a component that is functionally equivalent to each component described above, and a detailed description of the component is omitted.

Figure 9:
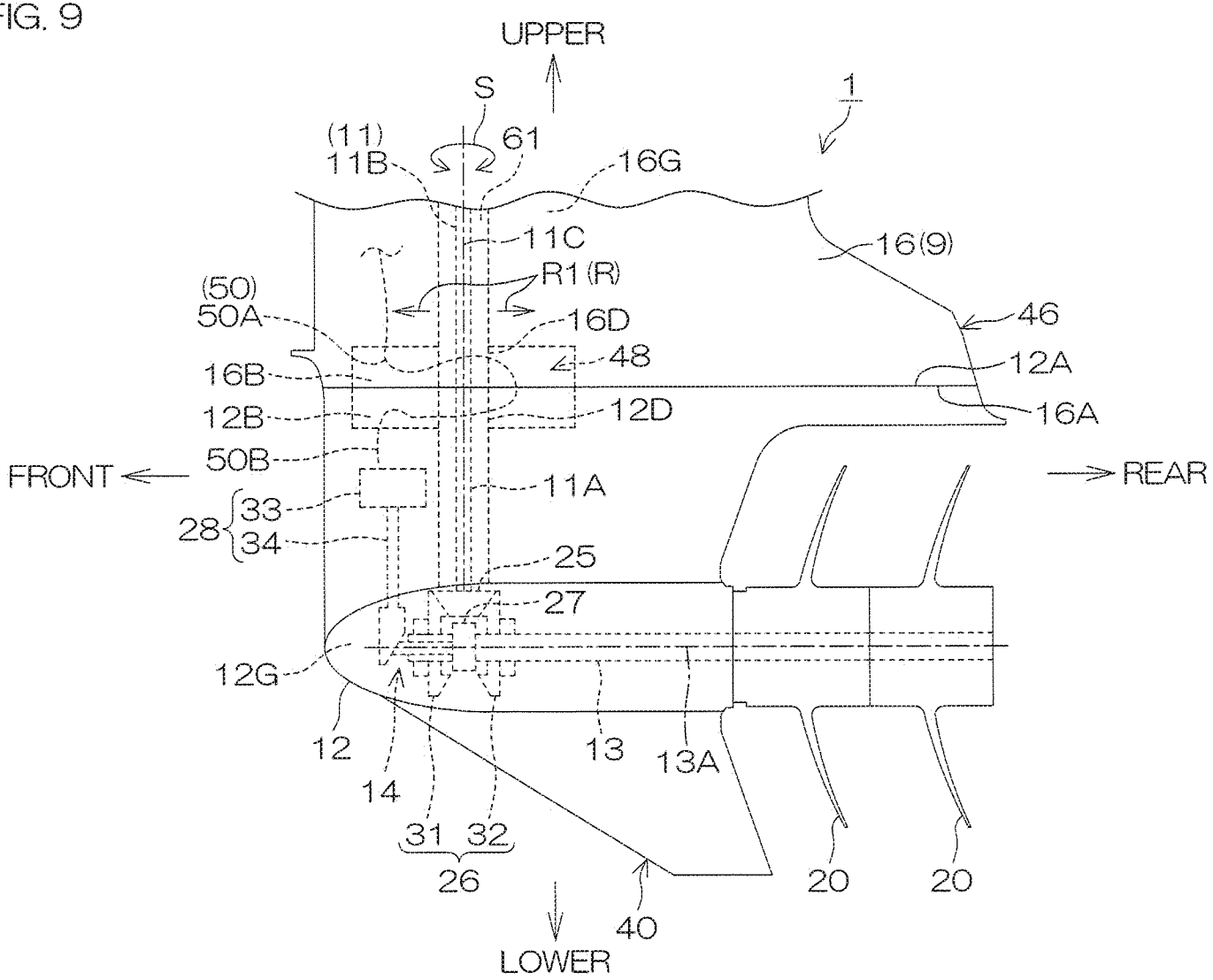
FIG. 9 is a side view of a lower portion of an outboard motor according to a first modification of a preferred embodiment of the present invention.

FIG. 9 is a left side view of a lower portion of an outboard motor 1 according to a first modification of a preferred embodiment of the present invention. In the outboard motor 1, a shaft housing chamber 61 that extends in the up-down direction and houses the drive shaft 11 extends across the drive shaft cover 16 and the lower housing 12. An internal space of each of the lower pipe 12D and the upper pipe 16D described above is a halfway portion of the shaft housing chamber 61. In the first modification, the upper space 16B and the lower space 12B are demarcated at the radially outward side R1 with respect to the shaft housing chamber 61 so as to surround the lower pipe 12D and the upper pipe 16D. Each of the upper space 16B and the lower space 12B may communicate with the shaft housing chamber 61.

In the first modification, a portion demarcated at the radially outward side R1 with respect to the shaft housing chamber 61 is used as the upper space 16B and as the lower space 12B. This makes it possible to locate the relay portion 50A of the harness 50 in the outboard motor 1 so as not to affect the relative turning of the lower unit 40.

Figure 10:
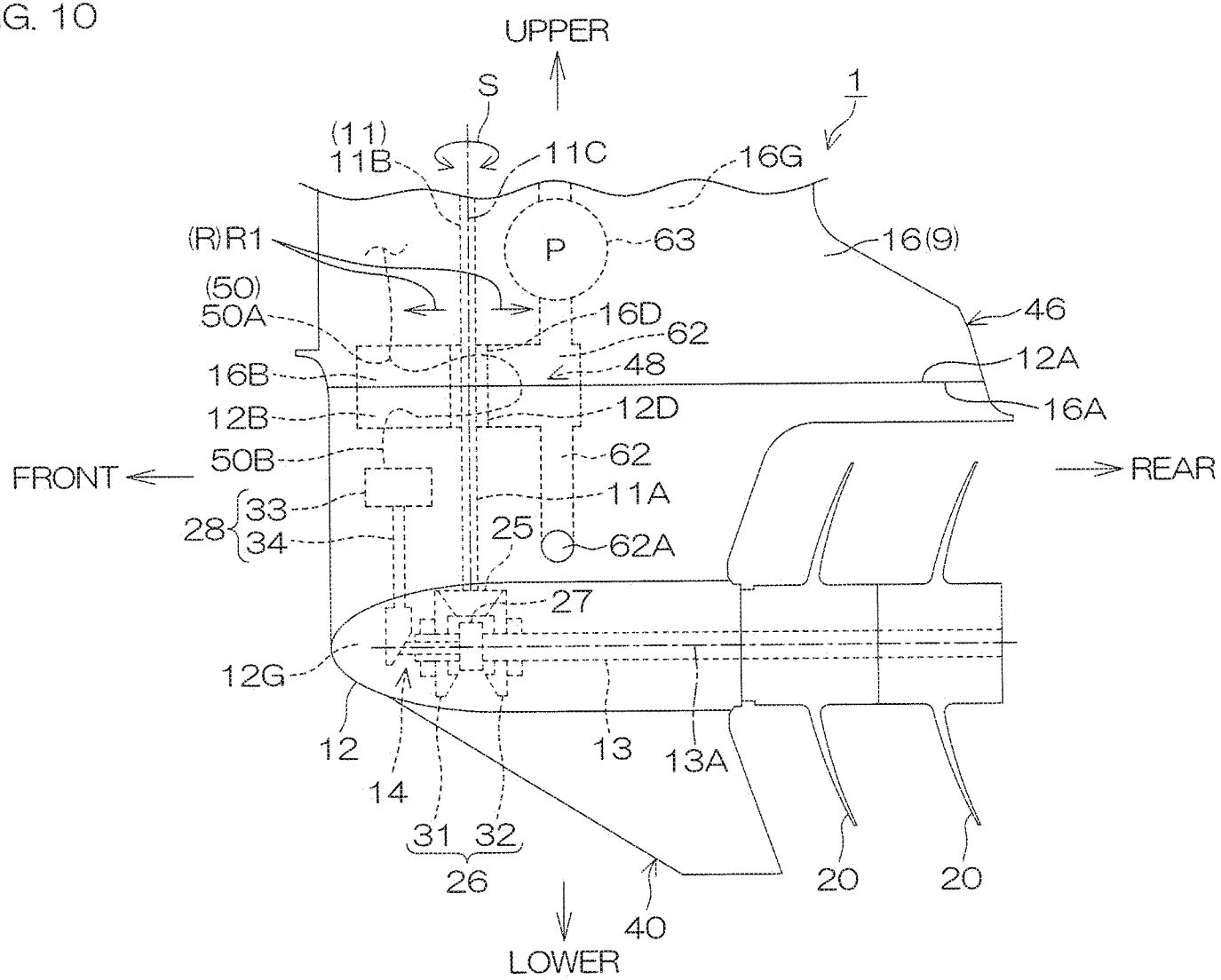
FIG. 10 is a side view of a lower portion of an outboard motor according to a second modification of a preferred embodiment of the present invention.

FIG. 10 is a left side view of a lower portion of an outboard motor 1 according to a second modification of a preferred embodiment of the present invention. In the outboard motor 1, a cooling water passage 62 through which cooling water that cools the engine 10 flows extends across the drive shaft cover 16 and the lower housing 12. The cooling water passage 62 extends in the up-down direction at a position away from the drive shaft 11 to at least any one of the forward, rearward, leftward, and rightward sides. A lower end of the cooling water passage 62 opens as a suction port 62A in the surface of the lower housing 12. For example, a pump 63 is provided at the cooling water passage 62 in the drive shaft cover 16. The pump 63 may be a mechanically-operated pump that is operated interlockingly with the rotation of the drive shaft 11, or may be an electric pump. When the pump 63 is operated, water around the outboard motor 1 is sucked from the suction port 62A, and flows through the cooling water passage 62, and is supplied to the engine 10 as cooling water.

In the second modification, the upper space 16B and the lower space 12B define a portion of the cooling water passage 62 by interposing the upper space 16B and the lower space 12B between both ends of the cooling water passage 62. With this arrangement, a portion of the cooling water passage 62 is used as the upper space 16B and as the lower space 12B, thus making it possible to locate the relay portion 50A of the harness 50 in the outboard motor 1 so as not to affect the relative turning of the lower unit 40.

If the harness 50 extends through the upper space 16B and the lower space 12B provided as a portion of the exhaust passage 36 as described above, a temperature switch 64 that detects the temperature of an exhaust gas in the exhaust passage 36 may be provided at the outboard motor 1 (see FIG. 2). When the temperature of the exhaust gas rises to a predetermined threshold value, the temperature switch 64 operates, and thus a process to prevent overheating of the engine 10 (for example, the running of the pump 63 to increase the quantity of cooling water) is performed in the outboard motor 1. This threshold value may be, i.e., the operation starting temperature of the temperature switch 64 may be, set at or below a temperature at which the harness 50 will be affected by the exhaust gas. In this case, when the temperature switch 64 operates, the temperature of the exhaust gas does not rise further, and therefore it is possible to prevent the harness 50 from being affected by the heat of the exhaust gas or the like.

In an example in which a plurality of propellers 20 are provided and disposed in the front-rear direction, an electric actuator (not shown) that changes an interval between the propellers 20 may be provided in the lower housing 12 as an example of the above-described electrical component. A sensor may be another example of the electrical component.

As described above, the steering actuator 41, which is provided at the upper unit 46, and the rack gear 45, which is disposed on the lower unit 40 side and which engages with the pinion gear 44 of the steering actuator 41, are provided as an arrangement required to turn the lower unit 40. As another arrangement, for example, a gear corresponding to the rack gear 45 may be provided at the outer peripheral surface of the lower pipe 12D (see FIG. 3) of the lower housing 12. In this case, the lower pipe 12D is inserted into the upper pipe 16D, and the gear (not shown) of the outer peripheral surface of the lower pipe 12D engages with the pinion gear 44 in the drive shaft cover 16.

The drive shaft 11 is preferably a single shaft that linearly extends from the engine 10 to the transmission 14 along the up-down direction, but the drive shaft 11 may be divided into a plurality of divided shafts (not shown) between the engine 10 and the transmission 14. In this case, the divided shafts may be coaxial, or may be coupled together through a gear or the like while being deviated in the front-rear direction and/or the left-right direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a drive shaft extending downwardly from the engine and rotatable by power of the engine;

a drive shaft cover including an upper space extending along a circumferential direction around the drive shaft to cover an upper portion of the drive shaft;

a lower unit including a propeller, a propeller shaft to rotate together with the propeller, a transmission to transmit rotation of the drive shaft to the propeller shaft, an electrical component, and a lower housing; and a harness connected to the electrical component; wherein the lower housing includes a lower space that communicates with the upper space from below and houses the propeller shaft, the transmission, a lower portion of the drive shaft, and the electrical component;

the lower unit is joined to the drive shaft cover and rotatable with respect to the drive shaft cover along the circumferential direction around a steering axis coaxial with the drive shaft; and the harness extends through the upper space and the lower space and is connected to the electrical component in the lower housing.

2. The outboard motor according to claim 1, wherein the lower unit is turnable within a predetermined turning range with respect to the drive shaft cover, and the upper space and the lower space communicate with each other at any turning position within the turning range.

3. The outboard motor according to claim 1, wherein the harness extends in the circumferential direction, and is bent in the upper space or the lower space.

4. The outboard motor according to claim 1, wherein the lower unit includes an exhaust port;

an exhaust passage to guide exhaust gas emitted from the engine to the exhaust port extends across the drive shaft cover and the lower housing; and the upper space and the lower space define a portion of the exhaust passage.

5. The outboard motor according to claim 4, further comprising a harness cover in at least either one of the upper space and the lower space to cover the harness.

6. The outboard motor according to claim 1, further comprising:

a shaft housing chamber to house the drive shaft and extending across the drive shaft cover and the lower housing; wherein the upper space and the lower space are demarcated at a radially outward side with respect to the shaft housing chamber.

7. The outboard motor according to claim 1, further comprising:

a cooling water passage through which cooling water flows to cool the engine extending across the drive shaft cover and the lower housing; wherein the upper space and the lower space define a portion of the cooling water passage.

8. The outboard motor according to claim 1, wherein the transmission includes:

a rotary body to rotate interlockingly with rotation of the drive shaft;

a dog clutch to rotate interlockingly with the propeller shaft and movable between a connection position in which the dog clutch engages with the rotary body and a disconnection position in which the dog clutch is disconnected from the rotary body; and the electrical component includes a shift actuator to move the dog clutch.

9. The outboard motor according to claim 1, wherein the upper space and the lower space are each an annular space extending along the circumferential direction.

10. The outboard motor according to claim 1, wherein the harness includes a first harness connected to the electrical component in the lower housing through the lower space, and a second harness outside the lower housing and that is connected to the first harness through a connector;

an outer wall of the lower housing includes an insertion hole to communicate with the lower space and into which the first harness is inserted; and the outboard motor further comprises a seal to seal a gap around the first harness in the insertion hole.

11. The outboard motor according to claim 10, wherein the seal includes a plurality of arc-shaped grommets located around the first harness in the insertion hole; and the outboard motor further comprises a pushing member to push the grommets into the insertion hole.

12. The outboard motor according to claim 1, further comprising:

a steering actuator located in an upper unit along with the engine and the drive shaft cover to turn the lower unit around the steering axis; wherein the upper unit is located above the lower unit.

* * * * *